US007240746B2

(12) United States Patent
Overstreet et al.

(10) Patent No.: US 7,240,746 B2
(45) Date of Patent: Jul. 10, 2007

(54) BIT GAGE HARDFACING

(75) Inventors: James L. Overstreet, Tomball, TX (US); Robert J. Buske, The Woodlands, TX (US); Rudolf C. Pessier, The Woodlands, TX (US); Jeremy K. Morgan, Midway, TX (US)

(73) Assignee: Baker Hughes Incorporated, Houston, TX (US)

( * ) Notice: Subject to any disclaimer, the term of this patent is extended or adjusted under 35 U.S.C. 154(b) by 282 days.

(21) Appl. No.: 10/948,829

(22) Filed: Sep. 23, 2004

(65) Prior Publication Data

US 2006/0060387 A1 Mar. 23, 2006

(51) Int. Cl.
*E21B 10/00* (2006.01)

(52) U.S. Cl. ..... 175/374; 175/426; 175/425; 175/428

(58) Field of Classification Search ..... 175/374, 175/378, 425, 428, 339, 373, 426
See application file for complete search history.

(56) References Cited

U.S. PATENT DOCUMENTS 2,527,838 A 10/1950 Morlan et al.
3,800,891 A * 4/1974 White et al. ..... 175/374
5,291,807 A * 3/1994 Vanderford et al. ..... 76/108.2
6,360,832 B1 3/2002 Overstreet et al.
6,561,293 B2 * 5/2003 Minikus et al. ..... 175/420.1
6,651,756 B1 * 11/2003 Costo et al. ..... 175/374
6,766,870 B2 7/2004 Overstreet

* cited by examiner

*Primary Examiner*—David Bagnell
*Assistant Examiner*—Brad Harcourt
(74) *Attorney, Agent, or Firm*—Bracewell & Giuliani LLP

(57) ABSTRACT

An earth boring bit has at least one rotatable cone with a gage surface that engages a sidewall of a wellbore as the bit rotates. The gage surface has hardfacing bars spaced circumferentially apart from each other. A first group of the hardfacing bars extends from the inner edge of the gage surface to gage sides of the heel row cutting elements. A second group of the hardfacing bars extends from the inner edge of the gage surface to spaces between the heel row cutting elements, forming trimmer cutting elements. The hardfacing bars are made up of carbide particles in a metallic matrix.

19 Claims, 3 Drawing Sheets

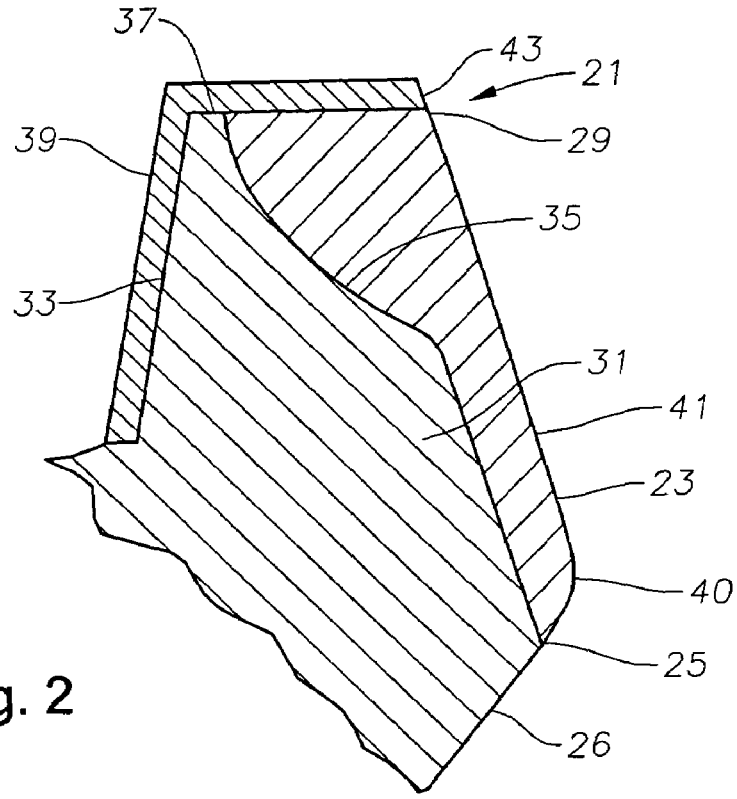
Fig. 2
Fig. 3
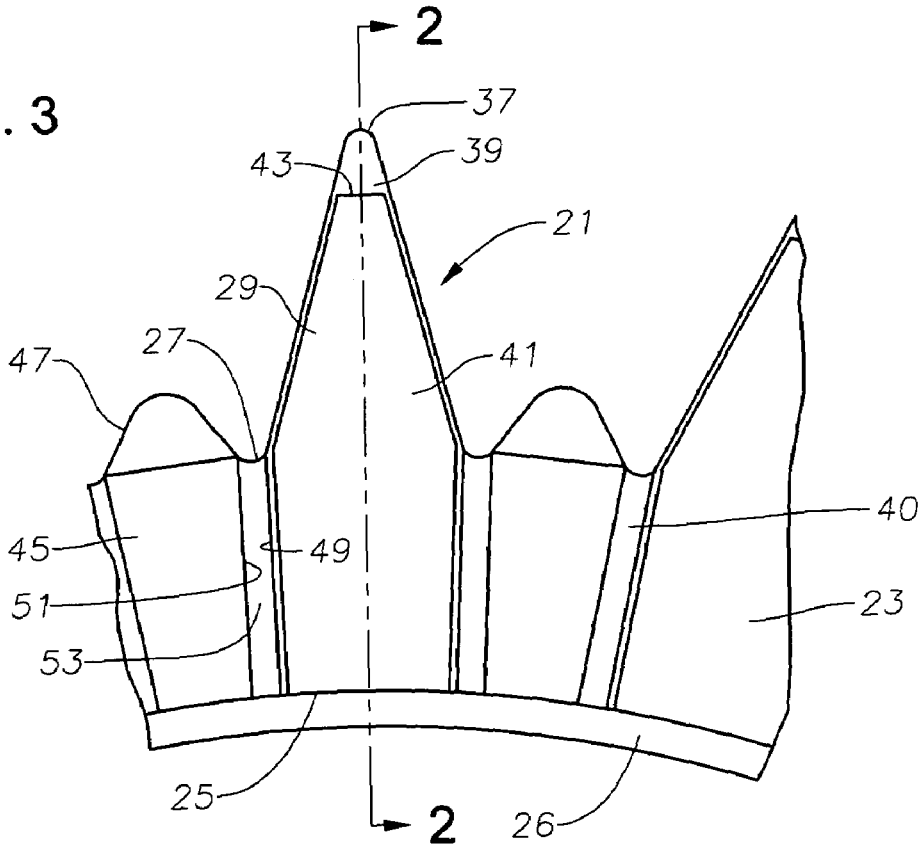

BIT GAGE HARDFACING

FIELD OF THE INVENTION

This invention relates in general to earth boring bits, and in particular to bits having hardfacing on the bit gage surface to reduce wear.

BACKGROUND OF THE INVENTION

A common type of earth boring bit has rotatable cones. Each cone is rotatably mounted to a bearing pin that depends from the body of the bit. The cones have cutting elements that disintegrate the earth formation as the bit body is rotated. The cutting elements may comprise tungsten carbide compacts press-fitted into holes in the supporting metal of the cones. Alternately, the cutting elements may be milled teeth that are integrally formed from the cone metal.

Each cone has a gage surface that engages the side of the bore hole as the bit rotates. In milled teeth cones, the teeth of the heel row, which is the row closest to the borehole wall, have gage sides that typically blend into the gage surface. The gage surface is an annular area that extends from a backface of the cone and joins the gage sides of the heel row teeth. Often trimmer cutting elements will be located between the heel row primary cutting elements at the outer periphery of the gage surface.

For many years, manufacturers have applied hardfacing to the milled teeth to reduce wear. Typically, the hardfacing is applied to the entire tooth, including its gage side, nose side, leading flank and trailing flank. In milled teeth bits, the trimmer cutting elements may be formed of a hardfacing deposit.

Under very abrasive formation conditions, the gage surface will round over and wear away the hardfacing. The underlying steel areas of the gage surface become exposed. Once exposed, the gage surface has very little resistance to wear under abrasive conditions. The gage surface will quickly wear, and the useful life of the bit will then be over because the bit will no longer be able to drill in-gage, causing bearing failure.

To reduce wear to the gage surface of milled teeth bits, manufacturers have extended the hardfacing from the gage sides of the heel row teeth to the inner edge of the gage surface. These hardfacing deposits were spaced apart from each other around the gage surface. The spaces on the gage surface between the hardfacing deposits were recessed and free of hardfacing.

SUMMARY OF THE INVENTION

In this invention, the gage surface has a hardfacing of carbide particles in a metallic matrix. The hardfacing extends from the inner edge of the gage surface to the cutting elements of the heel row and to trimmer cutting elements. A plurality of channels on the gage surface allows for the displacement of material generated by the cutting elements and trimmers.

In the preferred embodiment, the hardfacing covers the entire gage surface and the heel row teeth. Hardfacing bars or deposits are formed on the gage surface and gage sides of the teeth. The spaces between the bars define the channels. The channels extend from the inner edge of the gage surface to an outer periphery of the gage surface. A first group of the hardfacing bars extends from the inner edge of the gage surface to the valleys between the teeth, forming trimmer cutting elements. The second group of hardfacing bars extends from the inner edge of the gage surface onto the gage side of the heel row teeth.

In one embodiment, a first type of hardfacing is applied to portions of the teeth other than the gage sides. The hardfacing on the gage surface and the gage sides of the teeth is preferably more wear resistant than the first type but is not as tough.

BRIEF DESCRIPTION OF THE DRAWINGS

FIG. 2 is a sectional view of one of the heel row teeth of the bit in FIG. 1, taken along the line 2—2 of FIG. 3.

FIG. 3 is an enlarged elevational view of the gage side of a heel row tooth of the bit of FIG. 1.

DETAILED DESCRIPTION OF THE INVENTION

Figure 1:
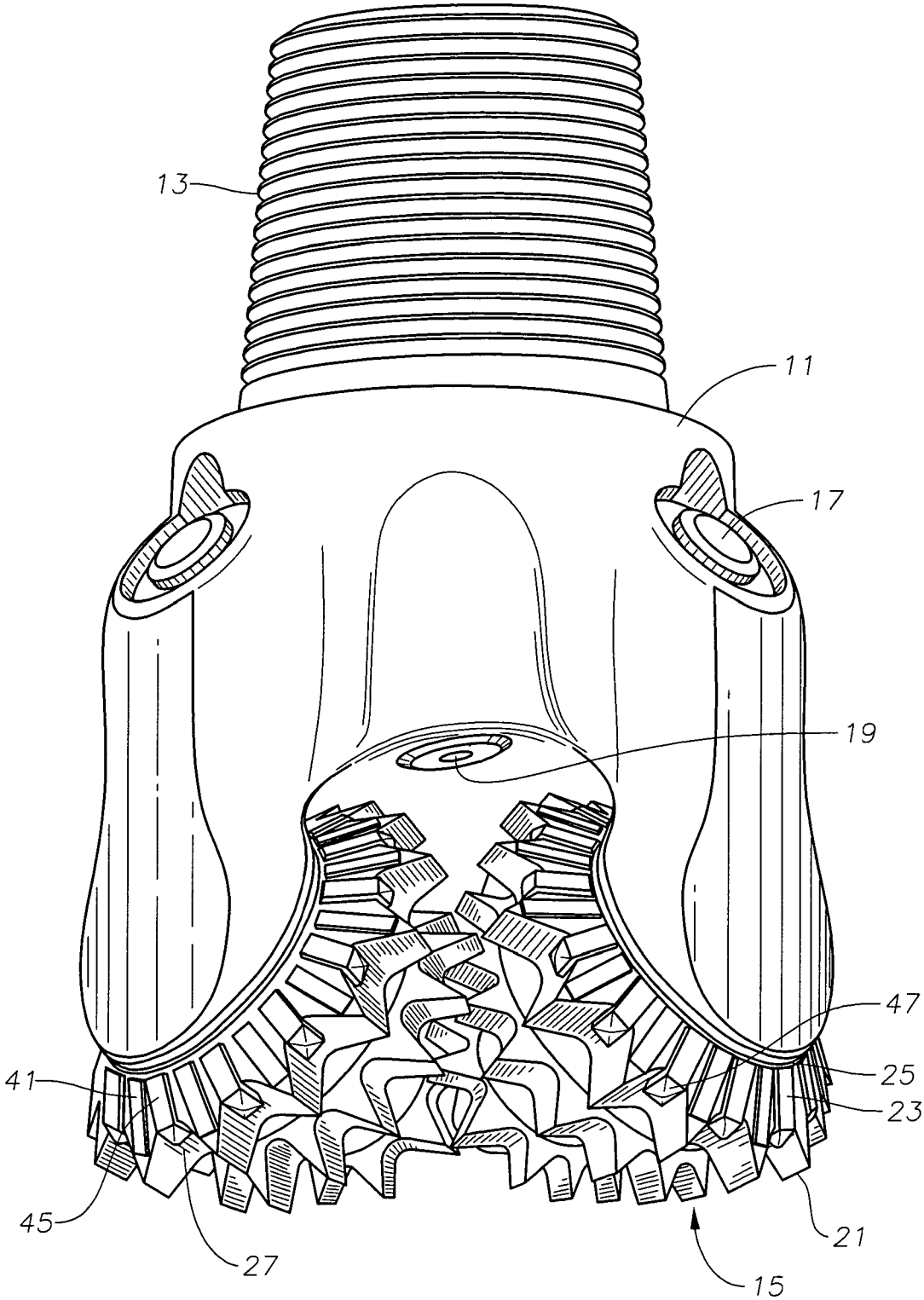
FIG. 1 is a perspective view of an earth boring bit constructed in accordance with this invention.

Referring to FIG. 1, the earth boring bit shown has a body 11 with a threaded upper end 13 for securing to a drill string. In this example, three cones 15 are rotatably mounted to depending bearing pins (not shown) of body 11. Body 11 has lubricant reservoirs for supplying lubricant to the bearings supporting each cone 15. A compensator 17 equalizes pressure differential between fluid in the borehole with the pressure of the lubricant. Body 11 has nozzles 19 for discharging drilling fluid, the drilling fluid sweeping cuttings from the borehole and returning them to the surface.

Each cone 15 has a generally frusto-conical main portion containing at least two rows of cutting elements, including a heel row 21. Heel row 21 is the row closest to a gage surface 23. Gage surface 23 engages the sidewall of the borehole as body 11 and each cone 15 rotates. Gage surface 23 thus determines the diameter of the borehole. In this embodiment, the cutting elements are milled teeth that are machined from the supporting metal of each cone 15. Alternately, cones 15 could have tungsten carbide inserts or compacts press-fitted into holes formed in the supporting metal of cones 15.

Referring to FIG. 3, a portion of gage surface 23 of one of the cones 15 is shown. Gage surface 23 is a frusto-conical surface that has an inner edge 25 joining a backface 26 of cone 15. Backface 26 is a flat machined surface that is perpendicular to the axis of rotation of cone 15. When cone 15 is installed on a bearing pin, backface 26 will be closely spaced to a machined surface (not shown) on one of the bit legs of bit body 11. Gage surface 23 extends outward from inner edge 25 to the frusto-conical main portion of cone 15. The outer periphery of gage surface 23 joins gage sides 29 of heel row teeth 21 and valleys 27, which are located between heel row teeth 21. In cones 15, gage sides 29 are flush with gage surface 23.

Figure 4:
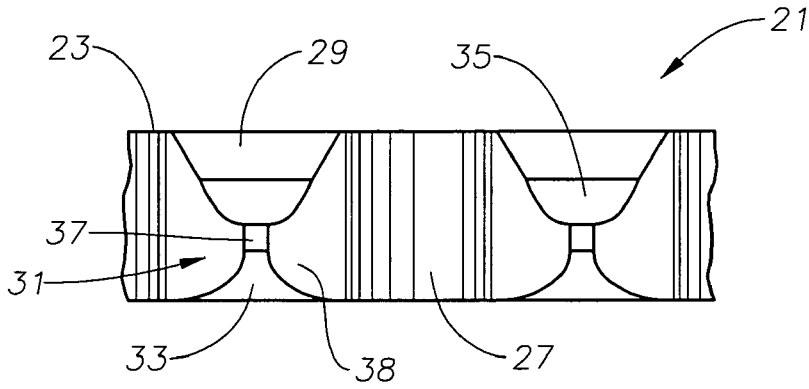
FIG. 4 is an elevational view of the top side of two of the heel row teeth of the bit of FIG. 1, shown prior to applying the hardfacing.

Referring to FIG. 2, each tooth of heel row 21 has an underlying tooth stub 31 that is machined from the steel body of cone 15. Tooth stub 31 has a nose side 33 that is typically flat and faces toward the central axis of rotation of bit body 11. Tooth stub 31 has a large recess 35 on its gage side 29. Recess 35 is preferably a concave surface formed at a selected radius. Recess 35 leads to a crest 37, which, prior to hardfacing, is greatly truncated in length because of the depth of recess 35. Tooth stub 31 also has leading and trailing flanks 38 (FIG. 4) that face into and away from the direction of rotation of cone 15. FIG. 4 shows two of the tooth stubs 31 from a top view prior to hardfacing, looking down on crests 37.

Referring again to FIGS. 2 and 3, a first type of hardfacing 39 is located on nose side 33, flanks 38 and crest 37 of each tooth stub 31. In this example, first type hardfacing 39 is not located in the tooth stub recess 35, or on the underlying steel body of cone 15 at gage surface 23. First type hardfacing 39 is also used to form trimmers 47, which are small cutting elements located in valleys 27 at the junction with gage surface 23. Trimmers 47 are smaller in height, width, and depth than the primary teeth of heel row 21. The thickness of first type hardfacing 39 may be the same as prior art hardfacing, which is typically up to about 0.125 inch. After application, first type hardfacing 39 is preferably not shaped or smoothed by grinding, although it could be, if desired.

A second type of hardfacing 40 entirely covers gage surface 23, and in the preferred embodiment, fills in recess 35 (FIG. 2) of each tooth stub 31. First type hardfacing 39 is applied to and becomes part of crest 37, and also overlays the portion of the second type hardfacing 40 that fills in recess 35. First type hardfacing 39 at crest 37 extends to gage side 29 of each tooth stub 31.

Referring also to FIG. 3, long and short hardfacing deposits or bars 41, 45 are formed with the second type of hardfacing 40 on gage surface 23. The term "bars" is not used in a limiting sense to refer to rectangular shapes, rather the shape can be varied. The terms "long" and "short" are used only for convenience and not in a descriptive sense. Long and short hardfacing bars 41, 45 alternate with each other in this embodiment, but more than one short bar 45 could locate between two long bars 41, particularly in larger diameter bits. Hardfacing bars 41, 45 extend generally along radial lines emanating from an axis of rotation of cone 15, but they could be inclined relative to the radial lines. Hardfacing bars 41, 45 could have the same widths, or the widths could differ.

Long bars 41 extend outward from gage surface inner edge 25 onto gage side 29 of each tooth of heel row 21. In the example shown, the outer end 43 of each long hardfacing bar 41 terminates short of crest 37, but it could extend completely to crest 37, entirely covering gage side 29. Preferably, each short hardfacing bar 45 extends from gage surface inner edge 25 to one of the valleys 27 between the teeth of heel row 21. In this example, the outer end of each short hardfacing bar 45 terminates at one of the trimmer cutting elements 47, which is formed of the first type of hardfacing 39. Each trimmer 47 protrudes outward beyond valley 27 and has a gage side that is flush with one of the short hardfacing bars 45.

Hardfacing bars 41, 45 have opposed lateral edges 49, 51 that are circumferentially separated from each other and generally parallel, as shown in FIG. 3, however due to the welding process, lateral edges 49, 51 will be irregular. Lateral edges 49, 51 define flow channels 53 that extend from gage surface inner edge 25 to valleys 27. Each flow channel 53 is generally parallel to hardfacing bars 41, 45 in this embodiment, and substantially parallel to a radial line emanating from the axis of rotation of cone 15. Lateral edges 49, 51 form the sides of flow channels 53, and the base of each flow channel 53 is formed by the second type of hardfacing 40.

First and second types of hardfacing 39, 40 are formed of carbide particles in a metallic matrix. Hardfacing bars 41, 45 are not pre-formed, rather they are formed at the same time they are being applied to cone 15 (FIG. 1). Preferably, first and second types of hardfacing 39, 40, including hardfacing bars 41, 45, are applied by a welding torch in a conventional manner. One method of applying second type hardfacing 40 to gage surface 23 is to first apply a continuous uniform thickness layer of second type hardfacing 40 on gage surface 23, then build up hardfacing bars 41, 45 on the continuous uniform thickness layer.

After hardfacing types 39, 40 are applied, the gage sides of hardfacing bars 41, 45, trimmers 47 and crests 37 are ground smooth to the desired gage diameter. Normally, lateral edges 49, 51 of hardfacing bars 41, 45 will be left in the as welded condition, but they could be ground smooth if desired. The remaining portions of first and second types of hardfacing 39, 40 are also preferably left in the as-welded condition, but portions could be ground smooth if desired. The remaining as-welded portions of first type of hardfacing 39 include nose side 33, flanks 38, and crest 37 of each tooth stub 31 and trimmers 47. The remaining as-welded portions of second type of hardfacing 40 include the bases of channels 53.

The thickness of hardfacing bars 41, 45 prior to grinding may be approximately the same as the underlying continuous layer of second type hardfacing 40 or it could differ. After grinding, preferably each hardfacing bar 41, 45 protrudes at least 0.015 inch from the base of channel 53, making each channel 53 at least 0.015 inch in depth. Prior to applying first and second types of hardfacing 39, 40 the underlying supporting steel body of cone 15 at gage surface 23 will be machined to a dimension to accommodate the increased thickness due to hardfacing bars 41, 45.

In the preferred embodiment, first type of hardfacing 39 is of a tougher, but less wear-resistant material than second type of hardfacing 40. The difference in wear resistance of drill bit hardfacing may be accomplished in different ways as explained in U.S. Pat. No. 6,360,832. One way is by increasing the density of the carbide particles within second type of hardfacing 40 over that in first type of hardfacing 39. As a result, there will be more volume of carbide particles per unit volume in second type of hardfacing 40 than in first type of hardfacing 39. This may be done by making the majority of carbide particles in the hardfacing tubes for second type of hardfacing 40 smaller than the majority of carbide particles in the hardfacing tubes used to form first type of hardfacing 39. The term "majority" as used herein means by comparison in weight, not in total number of particles, because the carbide particles within first and second types of hardfacing 39, 40 may be of multiple sizes. If so, the size that makes up the majority of particles in each of the tubes by weight for hardfacing type 39 compared to the total weight of the other particles, will differ in dimension from the tubes for hardfacing type 40. The smaller size carbide particles can be more tightly packed together than larger particles, resulting in less matrix metal and thus a greater volume density per unit volume.

The carbide particles are placed within a welding tube as filler. Preferably the carbide filler has a weight of about 65 to 70% of the total weight of the tube. In one example, tubes for first type of hardfacing 39 may use the following carbide particles as filler:

16/20 mesh cemented tungsten carbide pellets 32.75%
20/30 mesh cemented tungsten carbide pellets 34.75%
20/30 mesh crushed cemented tungsten carbide 15%
60/85 mesh spherical cast tungsten carbide 15%

In the same example, tubes for second type of hardfacing 40 may contain the following carbide particles:

−30+40 mesh cemented tungsten carbide pellets 37.5%

−30+40 mesh crushed cemented tungsten carbide 10%

−35+85 mesh spherical cast 50%

In both grades, the cemented carbide referred to as pellets comprises granules that have generally spherical shapes. These pellets are not true spheres, but lack the corners, sharp edges and angular projections commonly found in crushed and other non-spherical carbide grains or particles. Cemented carbide pellets comprise crystals or particles of tungsten carbide sintered together with a binder, usually cobalt, into a generally spherical pellet configuration.

Another way to accomplish higher density is to increase the amount of filler in the rod, which is the percentage of carbide particles by weight to the steel alloy body of the tube. The steel alloy forms the matrix for the hardfacing. If the carbide particles in each rod were the same size, the rod with the higher percentage of filler by weight would be denser.

Figure 5:
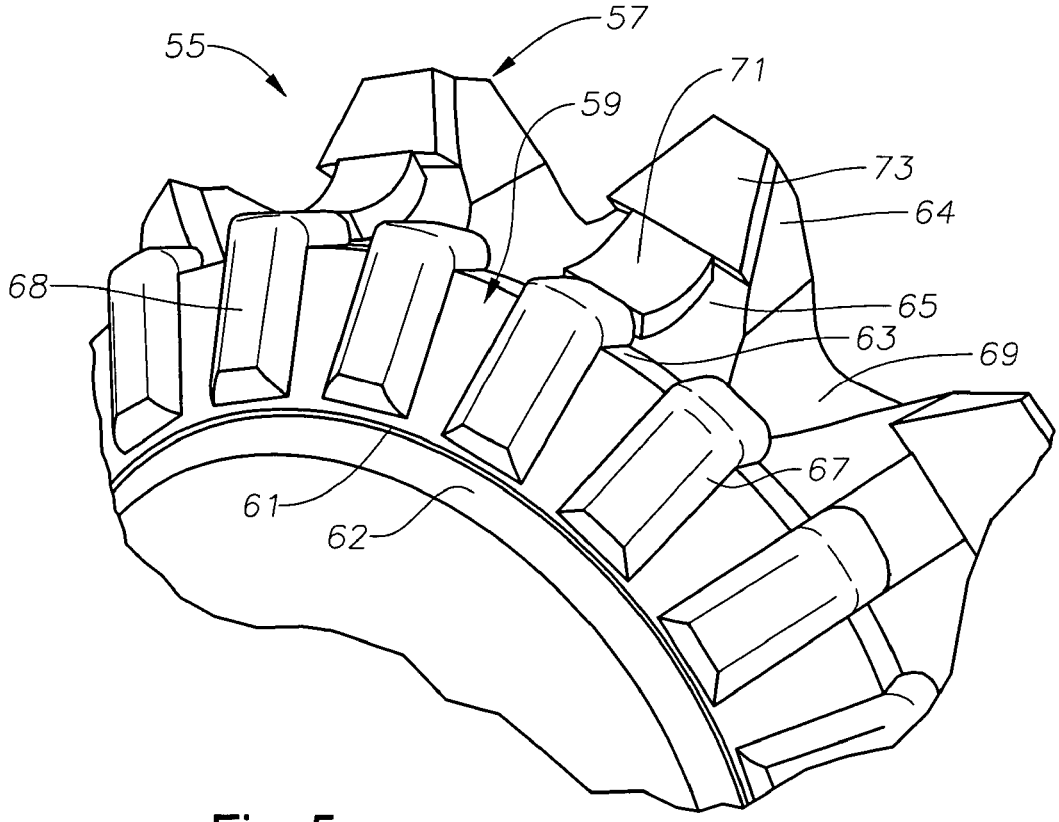
FIG. 5 is an enlarged perspective view of part of a cone of the bit of FIG. 1 that is not shown in FIG. 1.

FIG. 5 shows a third cone 55 for the bit of FIG. 1. In this embodiment, third cone 55 differs from the two cones 15 shown in FIG. 1 in that heel row 57 is offset from gage surface 59. That is, heel row 57 is spaced closer to the nose of cone 55 than heel rows 21 of cones 15 (FIG. 1). Alternately, third cone 55 could be configured with heel row 57 being non-offset as in the other two cones 15. As another alternative, third cone 55 could have every other tooth of heel row 57 flush with gage surface 59, with the alternating teeth being staggered.

In FIG. 5, gage surface 59 has an inner circumferential edge 61 at backface 62 and an outer circumferential edge 63. As in the first embodiment, a first type of hardfacing 64 is applied over the nose side, crest, and flanks of the teeth of heel row 57. A second type of hardfacing 65 is applied over gage surface 59, and the portion of the cone 55 between gage surface 59 and heel row 57. Short and long hardfacing bars 67, 68 are formed of second type hardfacing 65 on gage surface 59. Hardfacing bars 67, 68 alternate with each other and are spaced apart from each other with the spaces between forming channels for fluid flow. The edges of the protruding hardfacing bars 67, 68 form the sides of the channels, and the base of each channel is formed by less thick second type hardfacing 65 between the edges.

Hardfacing bars 67, 68 extend from inner edge 61 to outer edge 63 of gage surface 59. In this embodiment, hardfacing bars 67, 68 are approximately the same width, but they could differ. Each of the long hardfacing bars 68 aligns with one of the heel row teeth 57. Short hardfacing bars 67 align with valleys 69 between teeth of heel row 57. The outer end of each short hardfacing bar 67 protrudes above each valley 69 a short distance to form a scraper or trimmer cutting element. Alternately, the outer portion that forms the trimmer element could be formed of the first type of hardfacing 64.

In this example, extension bars 71 of the second type of hardfacing 65 extend from the outer end of each long hardfacing bar 68 to a gage side 73 of each heel row tooth 57. Preferably, extension bars 71 also extend up gage side 73, forming a layer of the second hardfacing 65 on the gage side of heel row teeth 57. Extension bars 71 on gage side 73 may terminate short of the crest, as in the first embodiment, or extend completely to the crest.

As in the first embodiment, the gage sides of hardfacing bars 67, 68 are ground to a desired diameter, and the portions of hardfacings 64, 65 not at the gage diameter left as welded. As in the first embodiment, first type of hardfacing 64 is of a tougher but less wear-resistant material than second type of hardfacing 65.

The invention has significant advantages. The hardfacing bars in both embodiments, when combined with the underlying hardfacing layer, create a hardfacing that is thicker than hardfacing used in the prior art on the gage surface. The spaces between the hardfacing bars provide channels for drilling fluid flow. The bases of the channels are protected also by the hardfacing. The tougher hardfacing type, which is used in areas of high impact such as on the teeth, reduces cracking of the hardfacing deposit. The more wear resistant but more brittle hardfacing, which is used on the surfaces that slide against the borehole sidewall, better reduces wear of the cone metal than the first hardfacing type.

While the invention has been shown in only two of its forms, it should be apparent to those skilled in the art that it is not so limited but is susceptible to various changes without departing from the scope of the invention. For example, although the drawings show the hardfacing bars extending generally along radial lines from the axis of rotation of the cone, they could be inclined either into or away from the direction of rotation of the cone. In such instance, the hardfacing bars would be inclined relative to radial lines of the axis of rotation of the cone. Also, as mentioned, the hardfacing bars could be applied to the gage surface of a tungsten carbide insert bit. In a tungsten carbide insert bit, the heel row cutting elements and the trimmers would be formed of tungsten carbide and pressed fitted into mating holes in the cone body.

The invention claimed is:

1. An earth boring drill bit, comprising:

at least one rotatable cone having a generally frusto-conical portion containing milled teeth for engaging a borehole bottom and having a gage surface for sliding contact with a sidewall of the borehole as the bit rotates, the gage surface having a circular inner edge concentric with an axis of rotation of the cone;

the teeth including a heel row adjacent the gage surface having gage sides;

the gage surface having a hardfacing of carbide particles in a metallic matrix, the hardfacing extending from the inner edge of the gage surface onto the gage sides of the heel row; and a plurality of channels on the gage surface leading from the inner edge for drilling fluid flow, each of the channels having a base formed of portions of the hardfacing.

2. An earth boring drill bit, comprising:

at least one rotatable cone having a generally frusto-conical portion containing cutting elements for engaging a borehole bottom and having a gage surface for sliding contact with a sidewall of the borehole as the bit rotates, the gage surface having a circular inner edge concentric with an axis of rotation of the cone;

the cutting elements including a heel row adjacent the gage surface and a plurality of trimmer cutting elements, each spaced between two of the cutting elements of the heel row and located at a junction with the gage surface and the frusto-conical portion;

the gage surface having a hardfacing of carbide particles in a metallic matrix, the hardfacing extending from the inner edge of the gage surface to the cutting elements of the heel row and also extending from the inner edge of the gage surface to the trimmer cutting elements;

a plurality of channels on the gage surface leading from the inner edge for drilling fluid flow; and wherein the hardfacing comprises:

a plurality of hardfacing bars of carbide particles in a metallic matrix separated from each other, with spaces between the hardfacing bars defining the channels and being overlaid with the hardfacing.

3. The bit according to claim 2, wherein each of the channels has side edges defined by portions of the hardfacing bars and a base connecting the side edges, the base being formed of portions of the hardfacing.

4. The bit according to claim 2, wherein:

the channels extend from the inner edge of the gage surface to the frusto-conical portion of the cone.

5. The bit according to claim 2, wherein the channels extend generally along radial lines emanating from an axis of rotation of the cone.

6. The bit according to claim 2, wherein the trimmer cutting elements are formed of carbide particles in a metallic matrix and are integrally formed with the hardfacing.

7. The bit according to claim 2, wherein:

the cutting elements of the heel row comprise milled teeth machined on the frusto-conical portion of the cone; and wherein the teeth of the heel row have gage sides onto which the hardfacing extends.

8. The bit according to claim 7, wherein the hardfacing comprises:

a first type of hardfacing welded onto and covering at least portions of each of the teeth of the heel row; and a second type of hardfacing welded onto the gage surface, the second type being formed of a material having more wear resistance than the first type of hardfacing.

9. An earth boring drill bit, comprising:

at least one rotatable cone having a gage surface for engaging a sidewall of a wellbore as the bit rotates, the gage surface having an inner circumferential edge concentric with an axis of rotation of the cone;

a heel row of primary cutting elements on the cone adjacent the gage surface; and a first group of hardfacing bars extending from the inner edge of the gage surface to the primary cutting elements of the heel row;

a second group of hardfacing bars extending from the inner edge of the gage surface to an outer periphery of the gage surface between the primary cutting elements of the heel row, the first and second groups of hardfacing bars comprising carbide particles in a metallic matrix; and a hardfacing layer of carbide particles in a metallic matrix substantially covering spaces of the gage surface between the first and second groups of hardfacing bars.

10. The bit according to claim 9, wherein the first and second groups of hardfacing bars are formed of a grade of material having a greater wear resistance than the hardfacing layer.

11. The bit according to claim 9 further comprising:

a plurality of trimmer cutting elements formed of hardfacing material, each of the trimmer cutting elements being located between two of the primary cutting elements of the heel row and on an outer periphery of the gage surface; and wherein the second group of the hardfacing bars joins the trimmer cutting elements.

12. The bit according to claim 9, wherein the hardfacing bars extend generally along radial lines emanating from an axis of rotation of the cone.

13. The bit according to claim 9, wherein:

the cutting elements of the heel row comprise milled teeth machined on the cone; and wherein the teeth of the heel row have gage sides onto which the first group of hardfacing bars extend.

14. An earth boring drill bit, comprising:

at least one rotatable cone having a gage surface for engaging a sidewall of a wellbore as the bit rotates, the gage surface having an inner circumferential edge substantially concentric with an axis of rotation of the cone;

a heel row of teeth located on the cone, each of the teeth having a crest, a nose side, a gage side, and leading and trailing flanks;

a first type of hardfacing of carbide particles in a metallic matrix substantially covering the nose side, the crest, and the flanks of the teeth of the heel row;

a second type of hardfacing of carbide particles in a metallic matrix extending from the inner circumferential edge to an outer periphery of the gage surface, the second type of hardfacing being of a grade having more wear resistance than the first type of hardfacing; and a plurality of channels in the second type of hardfacing, each channel extending from the inner circumferential edge to the outer periphery of the gage surface, the channels being spaced circumferentially apart from each other around the gage surface, the base of each of the channels being defined by the second type of hardfacing.

15. The bit according to claim 14, wherein portions of the second type of hardfacing extend onto portions of the gage sides of the teeth of the heel row.

16. The bit according to claim 14, further comprising a plurality of trimmer cutting elements, each of the trimmer elements being located between two of the teeth of the heel row and being formed of the first type of hardfacing.

17. The bit according to claim 14, wherein the channels extend generally along radial lines emanating from an axis of rotation of the cone.

18. The bit according to claim 14, wherein the second type of hardfacing extends onto part of the gage side of each of the heel row teeth, but terminates short of the crest.

19. The bit according to claim 14, wherein:

at least some of the teeth of the heel row are offset toward a nose of the cone from the outer periphery of the gage surface; and wherein the bit further comprises:

a plurality of spaced apart extension bars that extend from the outer periphery of the gage surface to the gage sides of said at least some of the teeth of the heel row, the extension bars being formed of the second type of hardfacing.

* * * * *